United States Patent [19]

Magneville

[11] Patent Number: 4,746,157

[45] Date of Patent: May 24, 1988

[54] LIFTING DEVICE FOR SETTING FLOATING OBJECTS AFLOAT IN THE WATER AND RAISING THEM, PARTICULARLY BOATS

[75] Inventor: Pierre Magneville, Vernouillet, France

[73] Assignee: Institut Francais de Petrole, Malmaison, France

[21] Appl. No.: 940,488

[22] Filed: Dec. 10, 1986

[30] Foreign Application Priority Data

Dec. 11, 1985 [FR] France ..... 85 18568

[51] Int. Cl.[4] ..... B63B 23/00; B66C 1/36

[52] U.S. Cl. ..... 294/82.27; 114/51; 114/365; 114/377

[58] Field of Search ..... 294/82.27, 82.1, 82.11; 414/678, 51, 365, 377; 405/1, 3

[56] References Cited

U.S. PATENT DOCUMENTS 1,808,945 6/1931 Butler .
3,266,353 8/1966 Gretter .

*Primary Examiner*—James B. Marbert
*Attorney, Agent, or Firm*—Antonelli, Terry & Wands

[57] ABSTRACT

A lifting device is provided for rapidly coupling and uncoupling a floating load, such as a boat, when it is set afloat or raised from the water. It includes essentially a hook secured to the load and a coupling element connected by cables to a lifting appliance. The concavity of the hook is turned downwards. Its section is trapezoidal and tapers towards its tip. The coupling element includes two arms whose facing walls are slanted and guide the hook towards the central housing. Springs, disposed laterally in the housing, come to bear against the lateral slanting faces of the hook and prevent it from leaving again.

12 Claims, 2 Drawing Sheets

LIFTING DEVICE FOR SETTING FLOATING OBJECTS AFLOAT IN THE WATER AND RAISING THEM, PARTICULARLY BOATS

BACKGROUND OF THE INVENTION

1. Field of the Invention

The invention relates to a lifting device for setting floating objects such as sea vehicles afloat in the water and raising them.

The invention relates more particularly to a lifting device including a suspended coupling element, adapted to be coupled with the load during the launching or raising operation.

The lifting device of the invention is particularly well adapted to handling boats subjected, because of the swell, to relative movements with respect to the lifting appliances. This is the case more particularly for floating objects, vehicles of low tonnage for example, which must be launched or raised by a lifting system on board a ship.

2. Description of the Prior Art

Lifting devices are known including a coupling element which is suspended by cables to a lifting appliance. This latter is operated for lowering the coupling element until it is brought into a position where one or more hooks secured to the load may be fixed thereto, either directly or by means of cables. The operation is generally impeded by the horizontal or vertical movements of the floating object or vehicle, relatively to the lifting device, under the effect of the swell, which often uncouple the hooks and the coupling element. The operation for seizing the hook or hooks must often be renewed several times. To the handling difficulties and dangers are added the risks of collision in the case where the boat is raised or lowered from a main ship, especially when the sea is rough. The lifting device of the invention overcomes the above mentioned drawbacks.

SUMMARY OF THE INVENTION

It includes a suspended coupling element connected by cables to handling means and includes a single hook secured to the object, whose concavity is turned downwards. It is characterized in that the lower face of this hook, on the concave side thereof, is wider than the opposite face and its lateral faces are slanted with respect to each other, and the coupling element includes a housing for the hook associated with spring means adapted for application against the lateral faces of the hook, when this latter comes into abutment against the bottom of the housing.

The spring means are, for example, springs disposed on each side of the housing, these springs being moved apart by the introduction of the hook into the housing. Blade springs may for example be used.

Preferably, the hook includes a finer tip, the width of the tip being chosen less than the spacing between the springs in the expanded position, so that movement of the coupling element towards the tip of the hook frees this latter from the springs.

The particular shape given to the hook in the central part which comes to bear against the bottom of the housing and the use of spring means coming into abutment against the lateral faces of the hook are sufficient, when the coupling element has come to engage it, in maintaining the coupling whatever the movements of the object relatively to the lifting device, particularly vertical movements.

The choice of the dimensions of the hook in the vicinity of its tip relatively to those of the housing allow the hook to be released at the end of the operation, by lowering and lateral movement of the coupling element relatively to the hook.

BRIEF DESCRIPTION OF THE DRAWINGS

Other features and advantages of the device of the invention will be clear from reading the description of a particular embodiment given by way of non limitative example, with reference to the accompanying drawings in which.

DESCRIPTION OF THE PREFERRED EMBODIMENT

Figure 1:
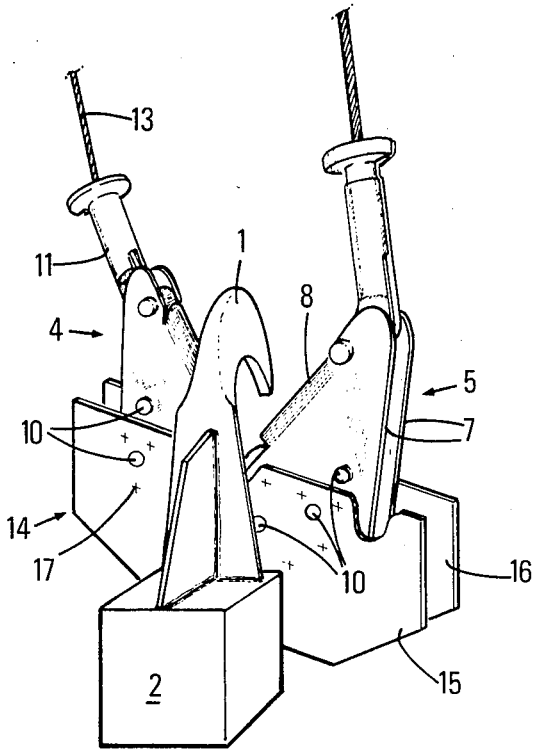
FIG. 1 shows schematically, in perspective the coupling element and the hook secured to the load.

The lifting device includes (FIGS. 1, 3) a single hook 1 fixed to a base 2, itself integral with the load to be raised. The base is disposed in line with the center of gravity. If the load is formed by a boat, the hook is preferably disposed on a disengaged platform of the superstructure. The concavity of the hook is directed downwards.

Figure 3:
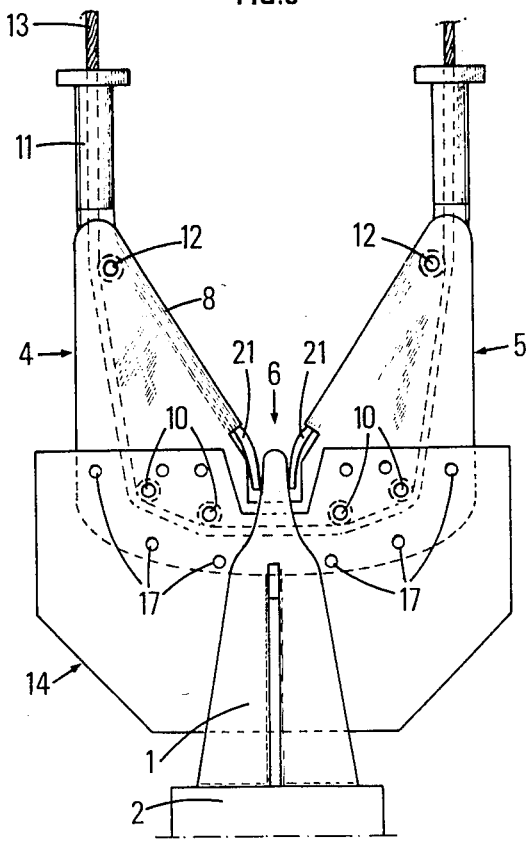
FIG. 3 shows schematically the hook in the coupling position in its housing in the coupling element.

The lifting device also comprises a coupling element 3 in the form of a V with two arms 4, 5 of a triangular shape secured together at their lower part. The two arms 4, 5 define therebetween a housing 6 for the hook 1 (FIG. 3). They each include two parallel plates 7 joined to each other at their upper part by a rounded wall 8. The two rounded walls 8 of the two arms are slanted symmetrically on each side of the vertical and form guides for centering the coupling elements 3 with respect to the hook. Inside each are disposed several pulleys 9 (FIG. 4) whose shafts 10 are fixed to the facing plates 7. A tubular guide 11 is disposed at the upper part of each arm (4,5). It may pivot with respect to the corresponding arm on a pin 12 also supported by the two opposite plates 7. The coupling element 5 is supported by a cable 13 which penetrates into one of the tubular guides 11, passes over all the pulleys 9 disposed inside the two arms and leaves through the opposite tubular guide. The pulleys are disposed so that the cable passes to the base of the two arms by passing round the central zone where the housing 6 for hook 1 is provided.

The lifting device also includes a protection apron 14 formed of two plates 15, 16 made from a shock absorbing material, from elastomer for example, which are disposed parallel to each other, outside the two arms and are fixed to plate 7 by bolts 17.

The purpose of apron 14 is to absorb the shocks which may occur between the coupling element and the superstructure of the boat during handling operations.

Figure 2:
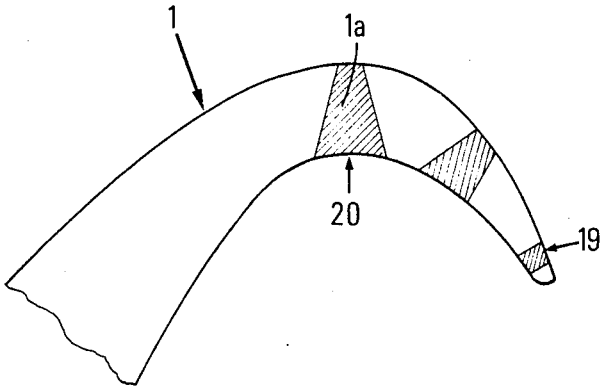
FIG. 2 shows, in a side view, a part of the hook and the particular shape which is given to its section in the zone thereof bearing against the coupling element and in the vicinity of its tip, the hatched parts showing the cross section of the hook in different positions.
Figure 4:
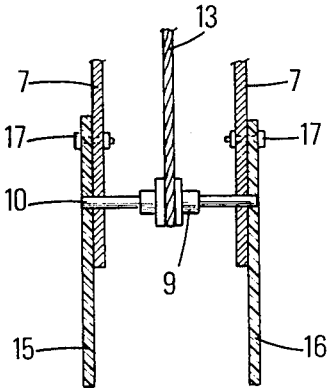
FIG. 4 shows a partial side view of the base of the coupling element showing one of the pulleys on which the support cable bears.
Figure 5:
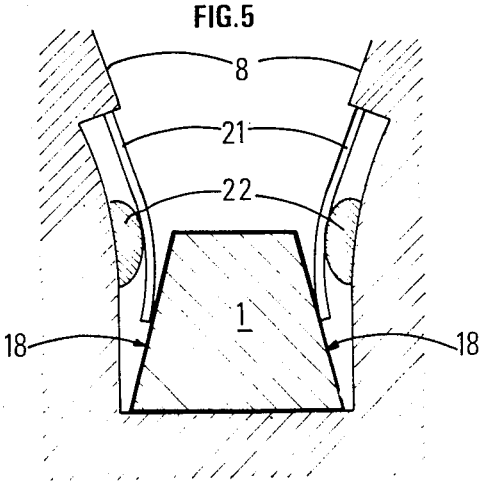
FIG. 5 shows schematically in section the hook in the bottom of its housing and a spring means exerting coupling forces laterally thereon.

Cable 13 is connected to a crane or hoisting gear of known type and not shown. An anti-pounding system of a type also known may be used for absorbing the shocks due to the particularly ample vertical movements of the load relatively to the hoisting gear, under the effect of the swell for example. It can be seen in FIG. 2 that the cavity of the hook is turned downwards and that the section of its central part 1*a*, which comes to bear against the bottom of the housing 6 of the coupling element 3, has a trapezoidal shape. The hook is wider on the side of its face bearing against the bottom of the housing than on the opposite side. The two side walls 18 (FIG. 2) are slanted towards each other. The section of the hook tapers towards its tip 19. The width of the bearing face 20 of the hook is substantially adapted to the width of the housing 6 (FIG. 4). Spring means 21 are disposed on each side of the housing. They are for example blade springs disposed symmetrically to the base of the slanting walls 8 of the two arms and penetrating into housing 6. Their spacing apart at rest is less than the width of the base 20 of the hook in the contact zone thereof. Flexion of the blade springs may be limited by pads 22 formed of a flexible material (polyurethane for example) which are fixed to the walls of the housing. The width of the tip 19 of the hook is less than the spacing between the springs in the relaxed position.

The blade springs 21 move apart so as to let the hook penetrate and, once this latter is in contact with the bottom of housing 6, they exert a retaining force on the slanting side walls 18, which prevents it from coming out again if the coupling element is lowered relative to the load under the effect of the swell.

Uncoupling is effected by moving housing 6 towards the tip 19 of hook 3 until, with the section of the hook decreasing, the coupling force of the blade springs 15 ceases.

Engagement is effected by moving the coupling element under the hook and by raising it by a pull exerted on cable 13. The particular V shape given to the facing walls 8 of the two arms 4, 5 allows the hook to be brought into its housing without proceeding by trial and error.

To release the hook after a handling operation, the cable is slackened and the coupling element is moved so as to cause housing 6 to slide towards tip 18.

In the absence of this particular releasing movement, the coupling of the coupling element and the hook holds good whatever their relative vertical movements. The operations for raising the load and setting it afloat are therefore very greatly simplified and very quick.

The device of the invention proves particularly useful in the system for conducting seismic operations described in French published patent application No. 2.574.560. This system in fact includes the use of one or more remote controlled motor boats which must be able to be set afloat at will from the main ship and raised again at the end of their operations. The safety and speed of handling which the lifting device provides is appreciable when coming alongside, especially when the swell is high.

The blade springs 21 may be replaced by equivalent means without departing from the scope and spirit of the invention.

What is claimed is:

1. A lifting device for setting floating objects afloat, particularly boats, and raising them again including a coupling element suspended from handling means and a single open hook secured to the object, whose concavity is turned downwards, wherein said hook is provided with a lower concave face wider than the opposite face and with lateral faces substantially flat and slanted with respect to each other and with a narrower tip portion and the coupling element includes a housing for the hook associated with deformable means adapted for being applied against the lateral faces of the hook when this latter comes into abutment against the bottom of the housing, said hook and said deformable means being so dimensioned that lowering and lateral movement of the coupling element results in a release of said hook.

2. The lifting device as claimed in claim 1, wherein said deformable means are springs disposed on each side of the housing, these springs being moved apart by introduction of the hook into the housing.

3. The lifting device as claimed in claim 2, wherein the coupling element includes pads made from a deformable material for limiting the lateral movement apart of the blade springs.

4. The lifting device as claimed in claim 2, wherein the coupling element includes two arms disposed on each side of the housing, whose facing walls are slanted so as to center the hook with respect to said housing.

5. The lifting device as claimed in claim 4, wherein said coupling element is suspended from cables by means of a plurality of pulleys disposed in an inner cavity.

6. A lifting device for setting floating objects afloat, particularly boats, and raising them again including a coupling element suspended from handling means and a single open hook secured to the object, whose concavity is turned downwards, said hook being provided on the concave side thereof with a lower face wider than the opposite face with lateral faces slanted with respect to each other and with a finer tip and the coupling element includes a housing for the hook associated with deformable means adapted for being applied against the lateral faces of the hook when this latter comes into abutment against the bottom of the housing, the width of said finer tip being chosen less than the spacing of the deformable means in the absence of a stress, so that movement of the coupling element towards the tip of the hook releases this latter from the deformable means.

7. The lifting device as claimed in claim 6, wherein said deformable means are formed by a blade spring.

8. The lifting device as claimed in claim 6, wherein said deformable means are formed by springs disposed on each said of the housing, these springs being moved apart by introduction of the hook into the housing.

9. The lifting device as claimed in claim 8, wherein the coupling element includes pad made from a deformable material for limiting the lateral movement apart of the blade springs.

10. The lifting device as claimed in claim 8, wherein the coupling element includes two arms disposed on each side of the housing, whose facing walls are slanted so as to center the hook with respect to said housing.

11. The lifting device as claimed in claim 10, wherein said coupling element is suspended from cables by means of a plurality of pulleys disposed in an inner cavity.

12. The lifting device as claimed in claim 6, wherein said deformable means are formed by a blade spring.

* * * * *